US005975113A

United States Patent [19]

Haining et al.

[11] Patent Number: 5,975,113

[45] Date of Patent: Nov. 2, 1999

[54] AIR CONDITIONER DRAIN PAN TREATMENT DISPENSER

[76] Inventors: Michael L. Haining, 6731 Ashmore, Houston, Tex. 77069; John E. Singletary, 10023 Jademont, Houston, Tex. 77070

[21] Appl. No.: 09/130,188

[22] Filed: Aug. 6, 1998

[51] Int. Cl.[6] ..... B01D 11/02

[52] U.S. Cl. ..... 137/268; 422/264

[58] Field of Search ..... 137/268; 239/310; 422/261, 264, 266

[56] References Cited

U.S. PATENT DOCUMENTS 3,579,440 5/1971 Bradley, Jr. ..... 137/268 X
4,962,778 10/1990 Driskill .
5,066,468 11/1991 Arnold et al. ..... 422/264 X
5,402,813 4/1995 Keen ..... 137/268 X
5,660,802 8/1997 Archer et al. ..... 137/268 X

*Primary Examiner*—Kevin Lee
*Attorney, Agent, or Firm*—Richard L. Moseley

[57] ABSTRACT

A dispenser for tableted chemical treatment material into an air conditioner condensate pan drain line comprises a container for the tablets and a removable cover sealed to the container by a gasket. The cover includes legs that extend into the container to prevent the tableted material from floating upward and blocking the inlet and outlet to the container. The container is secured in the drain line by conduits on either end.

11 Claims, 2 Drawing Sheets

AIR CONDITIONER DRAIN PAN TREATMENT DISPENSER

BACKGROUND OF THE INVENTION

1. Field of the Invention

The present invention relates to central air conditioners and more particularly relates to an apparatus for dispensing treatment chemicals for preventing the formation of drain blocking algae growth. More particularly the invention relates to an apparatus that may be placed in the drain line from the pan.

2. General Background

Generally central air conditioning units have the evaporator coils placed in the attic of homes because of the availability of space. Because of the nature of these units they require a reservoir called a drain pan for catching condensate water which is generated on a constant flow basis while the units are in operation. Most of the water drains from the pan through a drain line provided to a sewer or simply outside of the attic. However, there is typically a residue of water which remains in the pan at all times. The water remaining in the pan can become contaminated with algae growth, fungus and the like which can accumulate in the pan or drain line and cause a blockage. A blockage in the drain line can be disastrous for a home owner for the drain pan can overflow causing damage to the ceiling, walls and carpets.

The constant problem of drain blockage in the central air conditioning units has been a major problem since their inception. While several solutions are available most are primitive and manual. One of the most common is to put chemical agents in the drain pan to prevent the buildup of the algae and fungus.

Some of the chemical agents come as tablets which are placed in the pan and dissolve in the water. At least one of the tablet manufacturers packages the tablets in a multiple tablet holder with a sponge like support beneath the tablets for slow dissolving. Even this requires dismantling the service panel to access the drain pan. Thus a simple method of adding the chemical treatment, especially the tablets, was seen to be desirable. On of the problems associated with the tablets is that they tend to float to the surface and are not dissolved effectively.

SUMMARY OF THE INVENTION

The present invention provides a simple apparatus for introducing the tablets into the drain pipe condensate stream. The invention comprises a container having a removable cover and pipe fittings at either end for an inlet and outlet. The removable cover includes a lip for attachment to the container and legs for holding a package of tablets near the bottom of the container, preventing the package from floating upward and blocking the inlet and outlet. The cover is sealed onto the container by a gasket between the lip and the upper edge of the container.

DESCRIPTION OF THE PREFERRED EMBODIMENT

For a detailed description of the preferred embodiment the reader is directed to the accompanying figures in which like components are given like numerals for ease of reference.

Figures 1, 2:
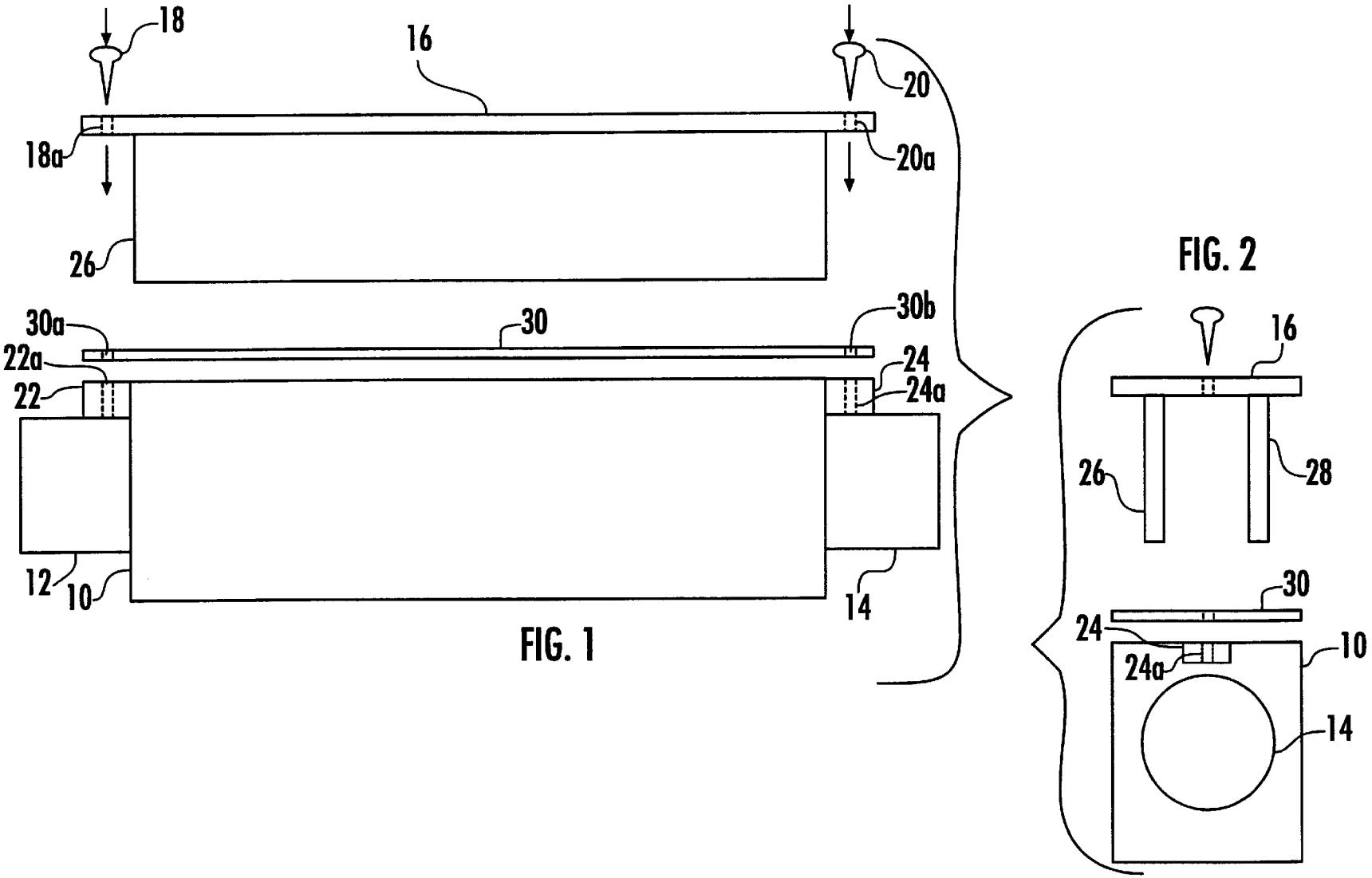
FIG. 1 is an exploded side elevational view of the dispenser of the present invention.
FIG. 2 is an exploded end elevational view of the dispenser of the present invention.

Referring first to FIGS. 1 and 2 there is shown an exploded view of the dispenser of the present invention. The dispenser is seen to comprise a container 10 having a removable cover 16 which is removably connected to the container. The cover 16 is sealed on the container 10 by gasket 30. Holding the entire device together are screws 18 and 20 which pass through openings in cover 18*a* and 20*a* and openings in gasket 30*a* and 30*b* and into threaded openings in ears 22 and 24 on container 22*a* and 24*a*. At either end of the container are tubular conduits 12 and 14. The conduits may be threaded internally or externally or simply left smooth which ever is appropriate for the drain pipe to which they are to be connected. One conduit is denoted as the inlet and the other the outlet. Since the dispenser is symmetrical which one is designated which does not matter. Extending from the bottom side of the cover 16 are two parallel legs 26 and 28 which extend part way downward into container 10. The height above the inlet and outlet conduits 14 and 12 is preferrably greater than the height of the pan lip above the drain pan outlet.

Figure 4:
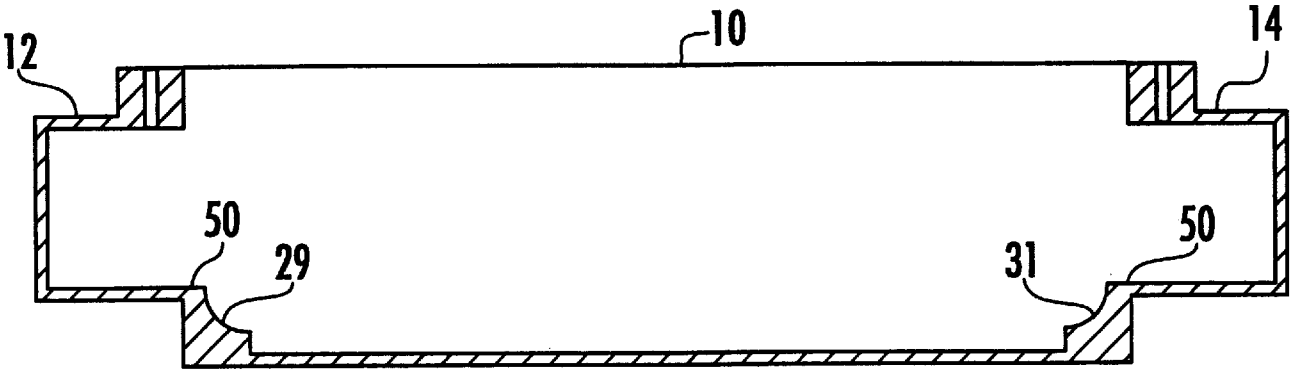
FIG. 4 is a side elevational view in partial cross section of the container of the present invention.

Referring now to FIG. 4 around the bottom of the container 10 is a lip 50 to provide a support for chemical tablets. The legs 26 and 28 extend down to the lip and hold the tablet container down. Finger depressions 29 and 30 are provide to remove the tablet container.

Figure 3:
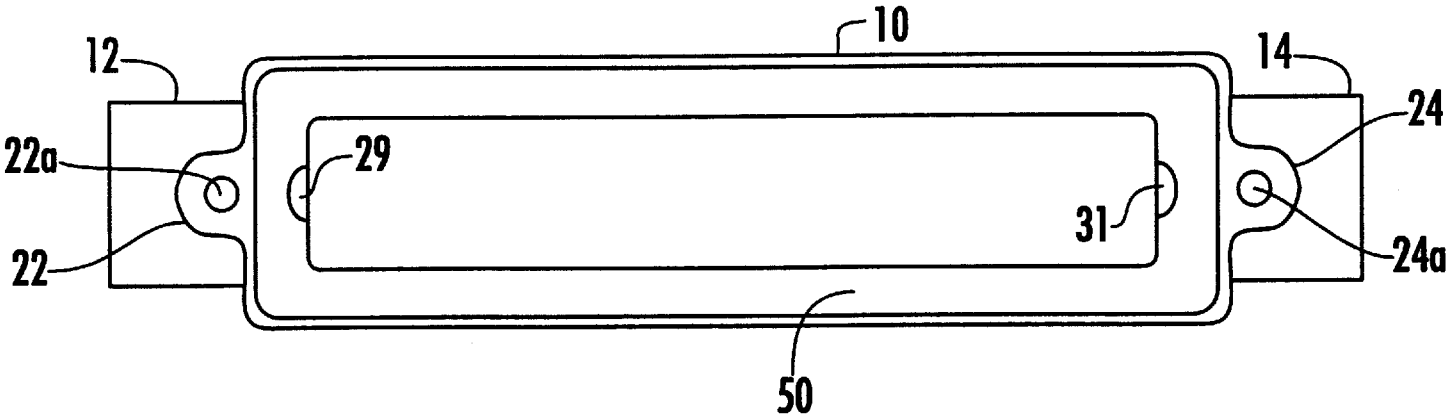
FIG. 3 is a top view of the container part of the dispenser of the present invention.

Referring now to FIG. 3 a top view of the container of the dispenser is shown. From this view the ears 22 and 24 with threaded openings a and a can be more clearly seen. The shape of the gasket 30 and outer edge of cover 16 conform to the shape of the top surface of the container 10 with the semicircular ears 22 and 24.

In use the dispenser is installed in the air conditioner condensate drain pan line, preferably outside the unit for easy access. The tablets are placed inside the container 10 and the cover 16 and gasket 30 are secured in place. If the tablets are in a tablet container the legs 26 and 28 rest against the tablet container to prevent the tablet container and tablets from floating upward and blocking the inlet and outlets. Otherwise the tablets themselves, being denser than water, rarely float on their own.

In one embodiment the removable cover 16 is transparent for inspection of the tablets. When the tablets are all dissolved the cover 16 is removed and new tablets placed in the container.

The invention claimed is:

1. A device for dispensing treatment chemical to prevent the formation of drain blocking algae growth in an air condition condensate pan drain line, comprising:

(a) a substantially rectangular container having an inlet and an outlet for connection in said drain line;

(b) a removable cover for attachment to said container, said cover having an upper surface and a lower surface, said lower surface abutting said container when secured thereto; and (c) legs extending perpendicularly downward from the lower surface of said cover into said container.

2. The device according to claim 1 wherein said cover is transparent.

3. The device according to claim 1 further comprising a gasket disposed between said container and said cover.

4. The device according to claim 1 wherein said legs extend substantially to the bottom of said container.

5. The device according to claim 1 wherein said inlet and outlet comprise tubular conduits secured to said container.

6. The device according to claim 5 wherein said tubular conduits are secured to opposites end of said container.

7. The device according to claim 5 wherein said tubular conduits are threaded internally.

8. The device according to claim 5 wherein said tubular conduits are threaded externally.

9. The device according to claim 6 wherein said tubular conduits are threaded internally.

10. The device according to claim 6 wherein said tubular conduits are threaded externally.

11. A device for dispensing treatment chemical to prevent the formation of drain blocking algae growth in an air condition condensate pan drain line, comprising:

(a) a substantially rectangular container having an inlet and an outlet on opposite ends for connection in said drain line;

(b) a removable cover for attachment to said container, said cover having an upper surface and a lower surface, said lower surface abutting said container when secured thereto;

(c) legs extending perpendicularly downward from the lower surface of said cover into said container; and (d) a gasket disposed between said container and said cover.

* * * * *